United States Patent [19]

Haman

[11] Patent Number: 4,946,410

[45] Date of Patent: Aug. 7, 1990

[54] MARINE PROPULSION DEVICE WITH IMPROVED OIL SEAL PROTECTION DEVICE

[75] Inventor: David F. Haman, Waukegan, Ill.

[73] Assignee: Outboard Marine Corporation, Waukegan, Ill.

[21] Appl. No.: 261,116

[22] Filed: Oct. 24, 1988

[51] Int. Cl.[5] ..... B63H 1/14

[52] U.S. Cl. ..... 440/83; 416/93 A; 416/146 A; 277/53; 277/68; 440/900

[58] Field of Search ..... 440/73, 75, 78, 83, 440/900; 416/93 A, 146 A, 245 A; 277/53, 68, 152

[56] References Cited

U.S. PATENT DOCUMENTS

| | | | |
|---|---|---|---|
| 67,982 | 8/1867 | Hudson | 440/73 |
| 965,870 | 8/1910 | Casaday | 440/73 |
| 2,515,303 | 7/1950 | Isnard | 287/53 |
| 3,943,790 | 3/1976 | Meyer | 440/78 |
| 4,180,368 | 12/1979 | Henrich et al. | 416/146 |
| 4,486,181 | 12/1984 | Cavil | 440/78 |
| 4,578,040 | 3/1986 | Sumino et al. | 440/73 |
| 4,609,361 | 9/1986 | Sumino et al. | 440/73 |

FOREIGN PATENT DOCUMENTS

| | | | |
|---|---|---|---|
| 2351006 | 4/1975 | Fed. Rep. of Germany | 277/152 |
| 749945 | 4/1933 | France . | |
| 164295 | 9/1984 | Japan . | |
| 178739 | 3/1962 | Sweden . | |

*Primary Examiner*—Sherman D. Basinger
*Assistant Examiner*—Edwin L. Swinehart
*Attorney, Agent, or Firm*—Michael, Best & Friedrich

[57] ABSTRACT

A marine propulsion device comprising a propulsion unit including a gearcase having a cylindrical inner surface centered on an axis, a propeller shaft which is located inside the inner surface, which is supported by the gearcase for rotation about the axis, and which has a rearward end adapted to have mounted thereon a propeller, and an annular oil seal extending between the propeller shaft and the inner surface, and a mechanism for protecting the oil seal from foreign matter, the mechanism including an annular member fixed on the propeller shaft, located between the oil seal and the rearward end of the propeller shaft, and spaced from the oil seal, the member having a generally circular outer surface spaced closely adjacent the inner surface and having a beveled surface portion facing the rearward end of the propeller shaft.

14 Claims, 1 Drawing Sheet

MARINE PROPULSION DEVICE WITH IMPROVED OIL SEAL PROTECTION DEVICE

BACKGROUND OF THE INVENTION

The invention relates to arrangements for protecting the propeller shaft oil seal of a marine propulsion device from fishline and other foreign matter.

Known arrangements include (1) "labyrinth" grooves cut into the gearcase housing, (2) cooperating cutting edges, one located on the propeller or propeller shaft and the other located on the gearcase housing, for shearing fishline, and (3) devices integral with the oil seal or oil seal outer shell. The third-mentioned arrangement is illustrated in FIG. 1, which shows a marine propulsion device 1 including an outer shell 3 that houses an oil seal 5 and that has thereon an annular, radially inwardly extending projection 7 that is intended to protect the oil seal 5 from fishline.

Attention is directed to the following U.S. Pat. Nos.:

| | | |
|---|---|---|
| Sumino | 4,609,361 | Sep. 2, 1986 |
| Sumino | 4,578,040 | Mar. 25, 1986 |
| Heinrich | 4,180,368 | Dec. 25, 1979 |
| Isnard | 2,515,303 | July 18, 1950 |
| Casaday | 965,870 | Aug. 2, 1910 |
| Hudson | 67,982 | Aug. 20, 1867 |

Attention is also directed to French Patent No. 749,945, Swedish Patent No. 178,739 and Japanese Patent No. 164,295.

SUMMARY OF THE INVENTION

The invention provides a marine propulsion device comprising a propulsion unit including a gearcase having a cylindrical inner surface centered on an axis, a propeller shaft which is adapted to be driven by an engine, which is partially located inside the inner surface, which is supported by the gearcase for rotation about the axis, and which has a rearward end adapted to have mounted thereon a propeller, and an annular oil seal extending between the propeller shaft and the inner surface, and means for protecting the oil seal from foreign matter, the means including an annular member fixed on the propeller shaft for rotation therewith, located between the oil seal and the rearward end of the propeller shaft, and spaced from the oil seal, the member having an outer surface spaced closely adjacent the inner surface and having a beveled surface portion facing the rearward end of the propeller shaft.

The invention also provides a marine propulsion device comprising a propulsion unit including a gearcase having a generally cylindrical inner surface centered on an axis, a propeller shaft which is adapted to be driven by an engine, which is partially located inside the inner surface, which is supported by the gearcase for rotation about the axis, and which has a rearward end adapted to have mounted thereon a propeller, and an annular oil seal extending between the propeller shaft and the inner surface and having an outer diameter, and means for protecting the oil seal from foreign matter, the means including an annular member fixed on the propeller shaft for rotation therewith, located between said oil seal and said rearward end of said propeller shaft, and spaced from said oil seal, said member having a circular outer surface spaced closely adjacent said inner surface and having an outer diameter less than said outer diameter of said oil seal.

The invention also provides a marine propulsion device comprising a propulsion unit including a gearcase having a generally cylindrical inner surface centered on an axis, said inner surface having a rearward end, a propeller shaft which is adapted to be driven by an engine, which is located partially inside said inner surface, which is supported by said gearcase for rotation about said axis, and which has a rearward end adapted to have mounted thereon a propeller, and an annular oil seal extending between said propeller shaft and said inner surface, and means for protecting said oil seal from foreign matter, said means including an annular member fixed on said propeller shaft for rotation therewith, located entirely between said oil seal and said rearward end of said inner surface, and spaced from said oil seal, said member having a generally circular outer surface spaced closely adjacent said inner surface.

A principal feature of the invention is the provision of the above-described annular member for protecting the oil seal from fishline and other foreign matter. The annular member is inexpensive, easy to install and easy to replace. The annular member has been found to be more effective than known arrangements for protecting the oil seal from fishline. Because the propeller, the propeller shaft and the member all rotate together, fishline wound around the propeller shaft does not rub against the member. Therefore, little or no heat is generated by rubbing of the fishline and the fishline does not melt. Fishline cannot travel between the member and the propeller shaft due to the intimate fit therebetween.

Other features and advantages of the invention will become apparent to those skilled in the art upon review of the following detailed description, claims and drawings.

Figure 2:
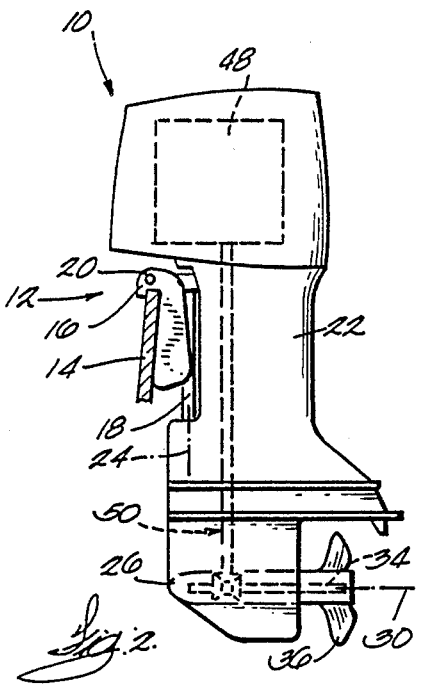
FIG. 2 is a side elevational view of a marine propulsion device embodying various features of the invention and including an annular member.
Figure 6:
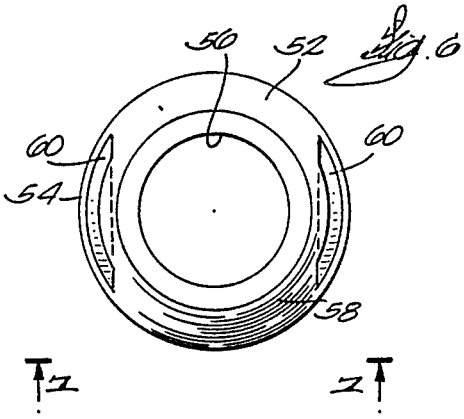
FIG. 6 is an elevational view of the annular member.
Figure 5:
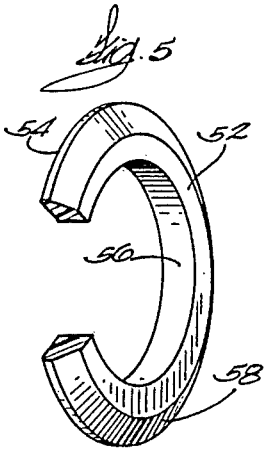
FIG. 5 is a perspective view of the annular member.
Figure 7:
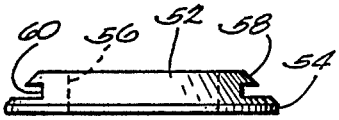
FIG. 7 is a view taken along line 7—7 in FIG. 6.
Figure 1:
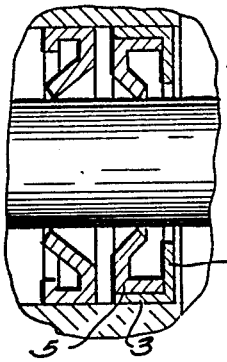
Fig. 1 PRIOR ART
FIG. 1 is a partial elevational view, partially in section, of a prior art marine propulsion device including an arrangement for protecting an oil seal from fishline.
Figure 3:
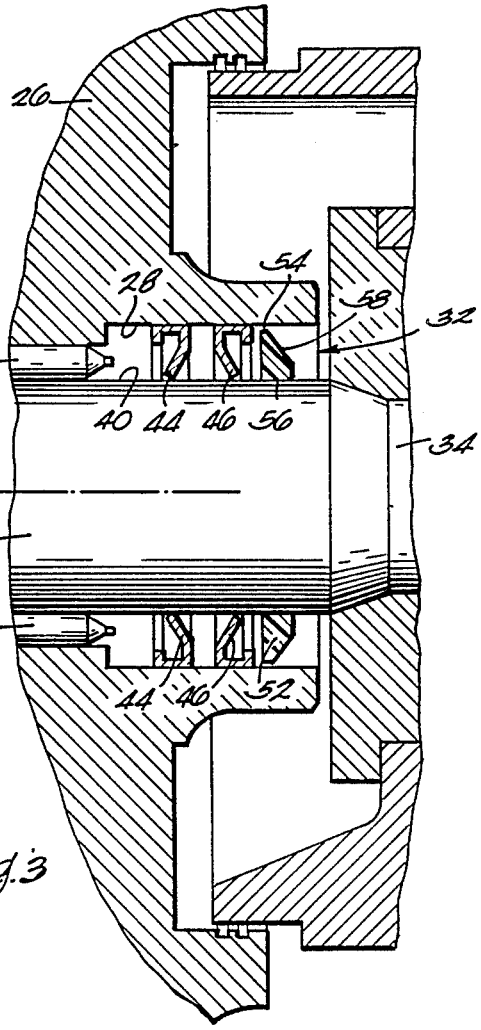
FIG. 3 is an enlarged, partial view of the marine propulsion device.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in FIGS. 2–7. While the illustrated marine propulsion device 10 is an outboard motor, it should be understood that the invention is applicable to other types of marine propulsion devices, such as stern drive units.

The marine propulsion device 10 comprises (see FIG. 2) a mounting assembly 12 adapted to be mounted on the transom 14 of a boat. While various suitable mounting assemblies 12 can be employed, in the preferred embodiment, the mounting assembly 12 includes a transom bracket 16 adapted to be fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24. The propulsion unit 22 includes a lower gearcase 26 having a generally cylindrical inner surface 28 (FIGS. 3 and 4) centered on an axis 30. The inner surface 28 has a right or rearward end 32 (FIG. 3) and an inner diameter. The propulsion unit 22 also includes a propeller shaft 34 located partially inside the inner surface 28 and supported by the gearcase 26 for rotation about the axis 30. The propeller shaft 34 has a right or rearward end extending outside the inner surface 28 and outside of the gearcase 26 and having mounted thereon a propeller 36. The propeller shaft 34 also includes (see FIG. 3) a cylindrical portion 38 having a generally cylindrical outer surface 40. Preferably, the propeller shaft 34 is rotatably supported by bearings 4 located between the outer surface 40 and the gearcase 26.

The propulsion unit 22 also includes inner and outer annular oil seals 44 and 46, respectively, extending between and engaging the outer surface 40 of the propeller shaft 34 and the inner surface 28 of the gearcase 26. The oil seals 44 and 46 have outer diameters which are substantially equal to the inner diameter of the inner surface 28 of the gearcase 26. The propulsion unit 22 also includes an engine 48 drivingly connected to the propeller shaft 34 by a conventional drive train 50. It should be noted that while, in the preferred embodiment, the engine 48 is part of the propulsion unit 22, the engine 48 can be separate from the propulsion unit 22.

The marine propulsion device 10 also comprises means for protecting the oil seals 44 and 46 from fishline 51 (FIG. 4) and other foreign matter. This means includes (see FIGS. 3–7) an annular member 52 fixed on the cylindrical portion 38 of the propeller shaft 34 for rotation therewith. The member 52 is located between the outer oil seal 46 and the rearward end 32 of the inner surface 28 of the gearcase 26 and therefore between the oil seal 46 and the rearward end of the propeller shaft 34. In other words, the annular member 52 is located entirely within the gearcase 26. The member 52 is also spaced from the propeller 36 and spaced from the outer oil seal 46. The member 52 has a circular outer surface 54 spaced closely adjacent the inner surface 28 of the gearcase 26 and has an outer diameter which is less than the outer diameter of the oil seals 44 and 46. Thus, a small clearance is provided between the annular member 52 and the inner surface 28 of the gearcase 26. This clearance prevents the member 52 from rubbing against the gearcase 26.

The clearance between the member 52 and the gearcase 26 can be very small due to the accurate location of the member 52 relative to the gearcase 26. This accurate location is possible because the member 52 is fit directly on the propeller shaft 34, which is in turn accurately located by the bearings 42. In the preferred embodiment, the annular member 52 is press fit onto the cylindrical portion 38 of the propeller shaft 34 and has a cylindrical inner surface 5 tightly engaging the outer surface 40 of the propeller shaft 34. In alternative embodiments, the annular member 52 can be secured to the propeller shaft 34 by other suitable means, such as glue or adhesive.

Figure 4:
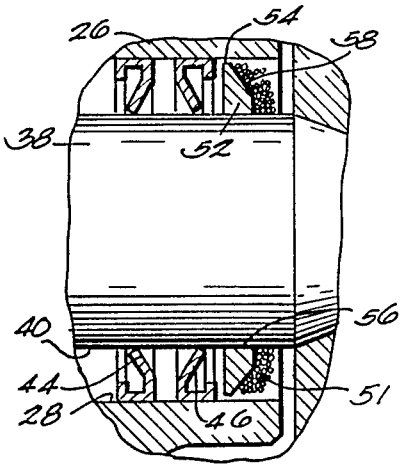
FIG. 4 is a partial view of FIG. 3 showing fishline wound around the propeller shaft.

Furthermore, in the preferred embodiment, the annular member 52 has a beveled or tapered surface portion 58 facing the propeller 36 or the rearward end of the propeller shaft 34. The beveled surface portion 58 of the annular member 52 "guides" fishline 51 radially inwardly or toward the propeller shaft 34 as it wraps around the propeller shaft 34. This is shown in FIG. 4. Therefore, the beveled surface 58 directs the fishline away from the annular space between the annular member 52 and the gearcase 26 and away from the oil seals 44 and 46. In alternative embodiments, the annular member 52 can be cylindrical instead of having the beveled surface portion 58.

Preferably, the annular member 52 also has therein (see FIGS. 6 and 7) a pair of circumferentially extending slots 60 which facilitate removal of the annular member 52 from the propeller shaft 34 with a screwdriver or similar tool.

Other features and advantages of the invention are set forth in the following claims.

I claim:

1. A marine propulsion device comprising a propulsion unit including a gearcase having a cylindrical inner surface with a rearward end and centered on an axis, a propeller shaft which is adapted to be driven by an engine, said propeller shaft being located partially inside said inner surface and spaced therefrom to define therebetween an annular space, said propeller shaft being supported by said gearcase for rotation about said axis, and said propeller shaft having a rearward end adapted to have mounted thereon a propeller, an annular oil seal extending in said annular space and engaging said propeller shaft and said inner surface, and means for protecting said oil seal from foreign matter, said means including an annular member fixed on said propeller shaft for rotation therewith, located in said annular space and between said oil seal and said rearward end of said cylindrical inner surface, and spaced from said oil seal, said member having an outer surface spaced closely adjacent said inner surface and having a beveled surface portion facing rearwardly.

2. A marine propulsion device as set forth in claim 1 wherein said oil seal has an outer diameter, and wherein said member has an outer diameter less than said outer diameter of said oil seal.

3. A marine propulsion device as set forth in claim 2 wherein said propeller shaft includes a cylindrical portion having a generally cylindrical outer surface, and wherein said member is located on said cylindrical portion and has a generally cylindrical inner surface.

4. A marine propulsion device as set forth in claim 2 and further comprising a propeller mounted on said rearward end of said propeller shaft, and wherein said member is spaced from said propeller.

5. A marine propulsion device as set forth in claim 1 wherein said member is press fit onto said propeller shaft.

6. A marine propulsion device as set forth in claim 1 wherein said member has a slot extending only partially circumferentially of said member.

7. A marine propulsion device comprising a propulsion unit including a gearcase having a generally cylindrical inner surface with a rearward end and centered on an axis, a propeller shaft which is adapted to be driven by an engine, said propeller shaft being located partially inside said inner surface and spaced therefrom to define therebetween an annular space, which is supported by said gearcase for rotation about said axis, and said propeller shaft having a rearward end adapted to have mounted thereon a propeller, an annular oil seal extending in said annular space and engaging said propeller shaft and said inner surface and having an outer diameter, and means for protecting said oil seal from foreign matter, said means including an annular member fixed on said propeller shaft for rotation therewith, located in said annular space and between said oil seal and said rearward end of said cylindrical inner surface, and spaced from said oil seal, said member having a circular outer surface spaced closely adjacent said inner surface and having an outer diameter less than said outer diameter of said oil seal.

8. A marine propulsion device as set forth in claim 7 wherein said propeller shaft includes a cylindrical portion having a generally cylindrical outer surface, and wherein said member is located on said cylindrical portion and has a generally cylindrical inner surface.

9. A marine propulsion device as set forth in claim 7 and further comprising a propeller mounted on said rearward end of said propeller shaft, and wherein said member is spaced from said propeller.

10. A marine propulsion device as set forth in claim 7 wherein said member is press fit onto said propeller shaft.

11. A marine propulsion device as set forth in claim 7 wherein said member has a slot extending only partially circumferentially of said member.

12. A marine propulsion device comprising a propulsion unit including a gearcase having a generally cylindrical inner surface centered on an axis, and having a rearward end, a propeller shaft which is adapted to be driven by an engine, said propeller shaft being located partially inside said inner surface and spaced therefrom to define therebetween an annular space, said propeller shaft being supported by said gearcase for rotation about said axis, and said propeller shaft having a rearward end adapted to have mounted thereon a propeller, an annular oil seal extending in said annular space and engaging said propeller shaft and said inner surface, and means for protecting said oil seal from foreign matter, said means including an annular member fixed on said propeller shaft for rotation therewith, located in said annular space and between said oil seal and said rearward end of said inner surface, and spaced from said oil seal, said member having a generally circular outer surface spaced closely adjacent said inner surface.

13. A marine propulsion device as set forth in claim 12 wherein said member is press fit onto said propeller shaft.

14. A marine propulsion device as set forth in claim 12 wherein said member has a slot extending only partially circumferentially of said member.

* * * * *